US009289733B2

(12) United States Patent
Maxon et al.

(10) Patent No.: US 9,289,733 B2
(45) Date of Patent: Mar. 22, 2016

(54) MIXING APPARATUS WITH STATIONARY SHAFT

(71) Applicants: James Maxon, Brockport, NY (US); Richard Howk, Pittsford, NY (US)

(72) Inventors: James Maxon, Brockport, NY (US); Richard Howk, Pittsford, NY (US)

(73) Assignee: SPX FLOW, INC., Charlotte, NC (US)

( * ) Notice: Subject to any disclaimer, the term of this patent is extended or adjusted under 35 U.S.C. 154(b) by 0 days.

(21) Appl. No.: 13/750,498

(22) Filed: Jan. 25, 2013

(65) Prior Publication Data

US 2014/0211585 A1 Jul. 31, 2014

(51) Int. Cl.

| | |
|---|---|
| ***B01F 5/12*** | (2006.01) |
| ***B01F 7/00*** | (2006.01) |
| ***B01F 7/22*** | (2006.01) |
| ***B01F 15/00*** | (2006.01) |

(52) U.S. Cl.

CPC ..... *B01F 7/0045* (2013.01); *B01F 7/22* (2013.01); *B01F 15/00019* (2013.01); *B01F 15/00681* (2013.01); *B01F 2015/0011* (2013.01); *B01F 2015/00084* (2013.01)

(58) Field of Classification Search

CPC ..... B01F 2005/0008; B01F 2005/0011; B01F 7/0045; B01F 7/22

USPC ..... 366/279, 282, 283, 285, 315, 270, 317

See application file for complete search history.

(56) References Cited

U.S. PATENT DOCUMENTS

| | | | |
|---|---|---|---|
| 1,850,199 | A | 5/1930 | Bryant |
| 2,963,281 | A | 4/1954 | Reiffen |
| 2,684,273 | A | 7/1954 | Fears et al. |
| 2,779,574 | A | 1/1957 | Schneider |

(Continued)

FOREIGN PATENT DOCUMENTS

| | | |
|---|---|---|
| AU | 467431 | 12/1975 |
| DE | 19514384 | 10/1996 |

(Continued)

OTHER PUBLICATIONS

Australian Search Report dated Aug. 28, 2014, corresponding with Application No. 201400421-2.

(Continued)

*Primary Examiner* — Tony G Soohoo
*Assistant Examiner* — Anshu Bhatia
(74) *Attorney, Agent, or Firm* — Baker & Hostetler LLP

(57) ABSTRACT

A mixing system for mixing fluids or the like in a mixing vessel. The mixing system includes a fixed conduit connected to the top portion of the vessel extends into the vessel. The system also has a rotating shaft having disposed within the fixed conduit that rotates within the fixed conduit while the mixing system is in operation. An impeller is attached to the rotating shaft. The impeller blade has a flat central disk portion, at least a pair of extensions extending from a central disk portion, and at least two leading edges defined by the outer periphery of the disk portion. Each leading edge spans from one extension to an adjacent extension, and each leading edge has at least a portion at which the radius of the leading edge from the center increases to form a continuous increasing radius curve. Each leading edge forms an increasing radius spiral edge surface in between the extensions.

18 Claims, 4 Drawing Sheets

(56) References Cited

U.S. PATENT DOCUMENTS

| | | | | |
|---|---|---|---|---|
| 2,875,897 | A * | 3/1959 | Booth | 366/270 |
| 3,202,281 | A * | 8/1965 | Weston | 366/279 |
| 3,820,759 | A * | 6/1974 | Hege | 366/134 |
| 4,577,975 | A | 3/1986 | McCrory et al. | |
| 4,813,786 | A | 3/1989 | LeMaster | |
| 4,900,159 | A * | 2/1990 | Jamison | 366/343 |
| 7,473,025 | B1 * | 1/2009 | Howk | 366/330.4 |

FOREIGN PATENT DOCUMENTS

| | | |
|---|---|---|
| DE | 20112588 | 10/2001 |
| WO | 2009099862 | 8/2009 |

OTHER PUBLICATIONS

European Search Report dated Jan. 9, 2015 for European Application No. 14152290.

* cited by examiner

MIXING APPARATUS WITH STATIONARY SHAFT

FIELD OF THE INVENTION

The invention pertains generally to mixing impellers, and more particularly to mixing impellers which are submerged in or at least partially in liquid material and rotated by a motor-driven shaft. More specifically, the invention pertains to a clean shaft housing that provides a non-rotating surface that limits the likelihood of the accumulation of solids or materials on the rotating shaft.

BACKGROUND OF THE INVENTION

Mixing impellers are in wide use in industry. Examples of industrial mixing impellers include designs which have a central hub and two, three, four or more radially extending blade type structures. These blades may be flat, angled, and in some cases have a wing or propeller shape. Typically, the impellers extend radially outwardly from a motor driven shaft and are submerged inside a material to be mixed. Oftentimes the impellers are in an at least partially liquid mix which is being confined in a vessel, which may be holding the material in a batch process or a continuous process.

In some types of mixing applications, an undesirable phenomenon occurs wherein various solid materials that are entrained in the liquid material being mixed will accumulate on the leading edge of the blade and form lumps, strings, or so-called "rags." A way to understand this phenomenon is to consider impellers used on boats, which will capture weeds that will then adhere to a leading edge of the boat propeller and impede its operational efficiency. Similarly, a ceiling fan will often accumulate dust from the air on its leading edge which will form into elongated filaments or streams.

A similar phenomenon occurs, particularly, for example, in the case of mixing impellers used for wastewater or sewage water treatment, wherein the material being mixed often has various types of crud, solid particulates, hair and other non-dissolving material. As the water is being treated, these materials sometimes tend to adhere to the leading edge of existing impeller types, which reduces the flow over the impeller type, and reduces the efficiency of the impeller. Similarly, these types of crud, solid particulates, hair and other non-dissolving material sometimes tend to adhere to the rotating shaft driving the impeller and can also impede the mixing system's operational efficiency.

In many industrial applications, the impellers are so-called "axial flow" in which the liquid in the region of the impeller is being pumped in the direction generally parallel to the axis of the shaft (perpendicular to the direction of extension of the blades). In other instances, the impellers may be the so-called "radial flow" type, in which the material is generally being urged radially outwardly away from the shaft in a direction parallel to the direction of extension of the blades. Some of these impellers have been known to utilize a circular disk having paddles radially extending outwardly therefrom.

In view of the foregoing, it would be desirable to have a mixing impeller and shaft design that can mitigate, at least to some extent, the effect of the development of "rags" or other collections adhering to the leading edge of the impeller and/or drive shaft.

SUMMARY OF THE INVENTION

Some aspects of some embodiments of the invention provide a mixing impeller and shaft combination that can mitigate, at least to some extent, the effect of the development of "rags" or other collections adhering to the leading edge of the impeller, or to the rotating shaft.

In one embodiment of the present invention, a mixing system for mixing components in a vessel having a top portion and a bottom portion is provided, comprising: a fixed conduit connected to the top portion of the vessel that extends at least partially to the bottom portion; a rotating shaft having a first end and a second end disposed within said fixed conduit that rotates within said fixed conduit while the mixing system is in operation; an impeller connected to said rotating shaft at said second end, said impeller comprising: a central disk portion having a center axis; at least a pair of extensions extending at an angle from the central disk portion; and at least two leading edges defined by an outer periphery of the central disk portion, each leading edge spanning from one extension to an adjacent extension, and each leading edge having at least a portion at which the radius of the leading edge from the center axis increases to form a continuous increasing radius curve.

In yet another embodiment of the present invention, a mixing apparatus is provided, comprising: a motor mounted to a mounting plate; a fixed conduit connected to mounting plate; a rotating shaft having a first end and a second end that is disposed within said fixed conduit that rotates within said fixed conduit wherein said first end is connected to said motor; and an impeller connected to said second end of said rotating shaft.

In still another embodiment of the present invention, a method for treating a material is provided, comprising: placing the material to be treated in a vessel; and disposing a rotational shaft within a fixed conduit connected to the vessel; rotationally driving the rotational shaft having an impeller blade attached thereto, the impeller blade comprising: a central disk portion having a center axis; at least a pair of extensions extending from the central disk portion; and at least two leading edges defined by the outer periphery of the central disk portion, each leading edge spanning from one extension to an adjacent extension, and each leading edge having at least a portion at which the radius of the leading edge from the center axis increases to form a continuous increasing radius curve.

In another embodiment of the present invention, a mixing system for mixing a fluid or the like in a vessel is provided, comprising: means for placing the material to be treated in a vessel; and means for disposing a rotational shaft within a fixed conduit connected to the vessel; means for rotationally driving the rotational shaft having an impeller blade attached thereto, the impeller blade comprising: a central disk portion having a center axis; at least a pair of extensions extending from the central disk portion; and at least two leading edges defined by the outer periphery of the central disk portion, each leading edge spanning from one extension to an adjacent extension, and each leading edge having at least a portion at which the radius of the leading edge from the center axis increases to form a continuous increasing radius curve.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Some embodiments of the present invention provide an impeller having a central disk portion, at least a pair of extensions extending from a central disk portion, and at least two leading edges defined by the outer periphery of the disk portion, each leading edge spanning from one extension to an adjacent extension, and each leading edge having at least a portion at which the radius of the leading edge from the center increases to form a continuous increasing radius curve. An aspect of this is that design provides in some circumstances a mixing impeller that can mitigate, at least to some extent, the effect of the development of "rags" or other collections adhering to the leading edge of the impeller, or to any edge of the impeller.

Figure 1:
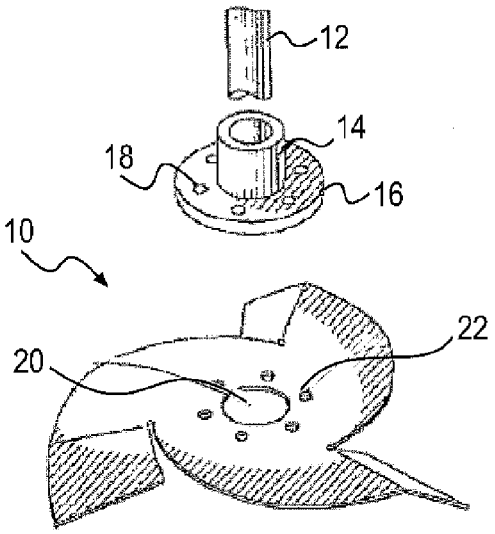
FIG. 1 is a perspective exploded view showing an impeller according to one example of a preferred embodiment of the invention.

Some preferred embodiments will now be described with reference to the drawing figures, in which like reference numbers refer to like parts throughout. FIG. 1 illustrates an impeller 10 which can be mounted to a shaft 12 via a mounting hub 14. The shaft 12 is illustrated as cut off, but typically would extend all the way through the hub 14 or the hub 14 can be mounted at the end of the shaft 12. Thus, several impellers 10 can be mounted along the length of a shaft. Typically, the shaft 12 extends inside a vessel (not shown) containing the material to be mixed, and is driven by a motor outside the vessel.

In the example shown, the hub 14 has a radially outward extending mounting flange 16 with a central base and a plurality of bolt holes 18 therethrough. The impeller 10 has a central aperture 20, through which the shaft 12 can pass, and also has a plurality of bolt holes 22 therethrough corresponding to the bolt holes 18. In this way, the impeller 10 can be rigidly affixed to the hub 14 by bolts passing through the bolt holes 22 and 18, respectively. The hub 14 can be affixed onto the shaft 12, both axially and rotationally, via any of many known attachment methods. For example, the hub 14 can be welded to the shaft 12. Similarly, the impeller 10 can be mounted to the hub 14 via any known attachment method, including, for example, by being welded. Also, the hub 14 could be integral with or permanently attached to the impeller 10.

Figure 2:
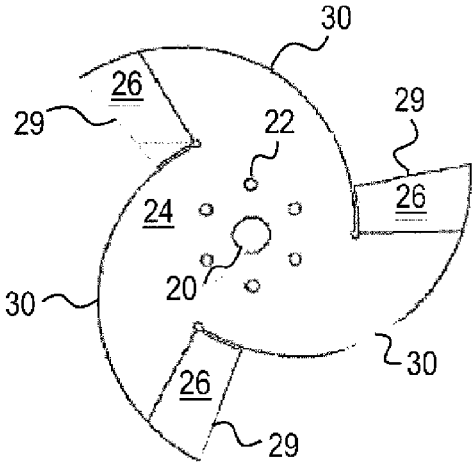
FIG. 2 is a top view of the impeller illustrated in FIG. 1.
Figure 3:
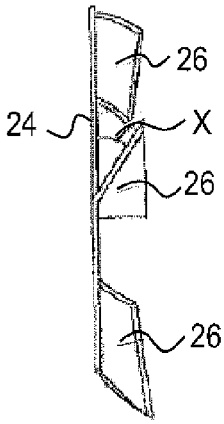
FIG. 3 is a side view of the impeller illustrated in FIG. 1.

Turning now in more detail to FIGS. 1-3, the illustrated impeller 10 includes a central disk region 24 which is substantially in the shape of a flat plate. One or more (in this case three) downwardly bent extensions 26 are provided and angle away from the disk region 24 as shown. In the illustrated example, the extensions 26 project away from the plane of the central disk portion 24 by a band angle X of approximately 30 degrees. It will be appreciated that this angle can be varied anywhere from practically zero up to 90 degrees, or anything up to 180 degrees. In the example shown, the 30 degree angle provides for generally axial flow pumping. If the blade is bent to 90 degrees, more radial flow pumping will occur.

In the example, three projecting extensions 26 are illustrated; however, any number of one or more, preferably two or more, extensions may be provided. In most preferred embodiments, the extensions will be two or more and will be symmetrically disposed around the circumference of the central disk region 24. Also, as discussed further below, the impeller blade 10 may optionally be a unitary design as shown in FIGS. 1-3. Such a design is convenient to form from a single flat plate which is cut to the desired outline shape, and then can have the extensions 26 bent downwardly by a suitable mechanical process.

However, in some cases, for example, in the case of large size impellers, it may be desirable to fabricate the impeller 10 from a plurality of parts that are welded together or otherwise attached to each other. For example, the individual extensions 26 can each be welded on at an angle to the central disk portion 24, and/or the central disk 24 itself and an associated extension can be made of individual components each with an associated extension.

Figure 4:
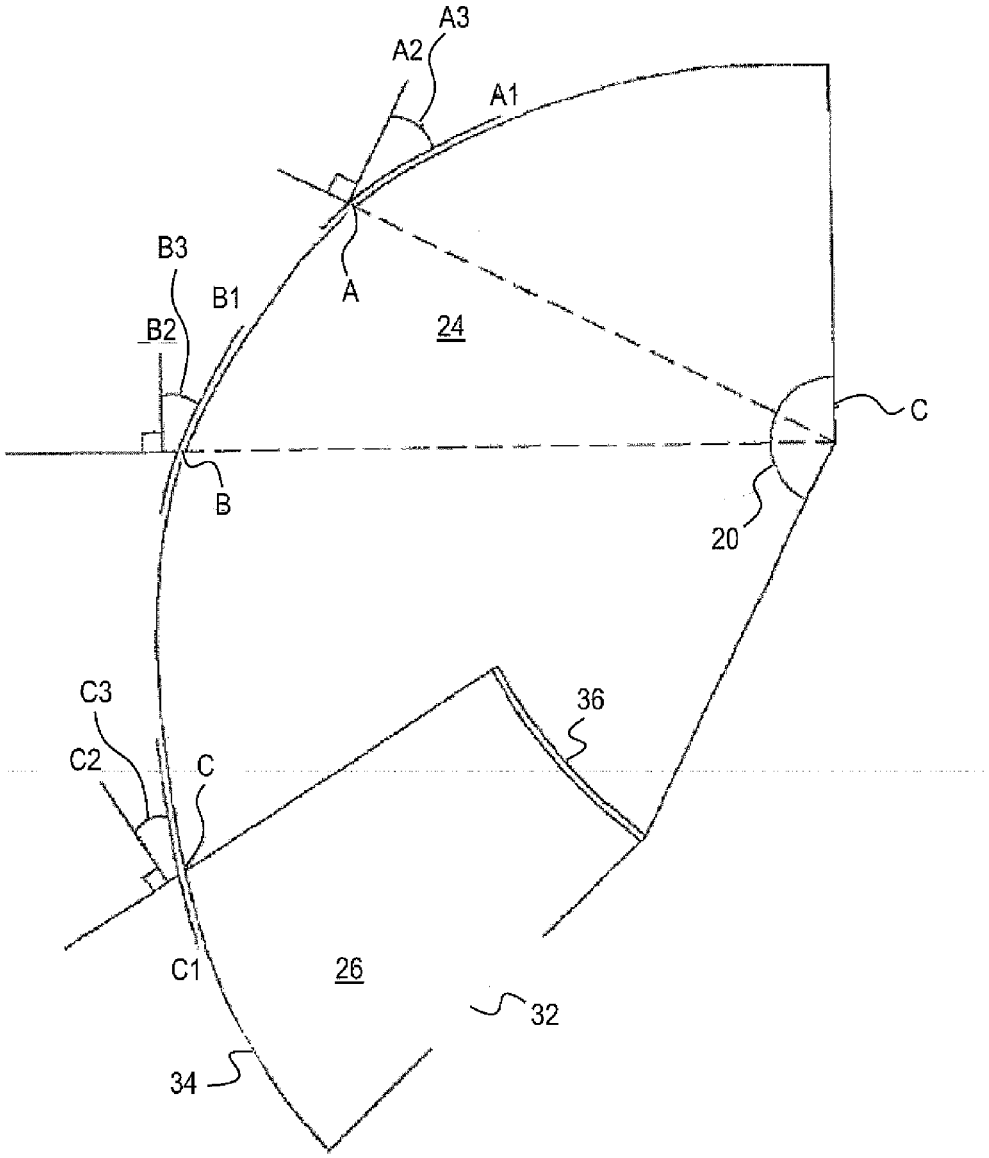
FIG. 4 is a geometric diagram illustrating some design aspects of an impeller according to another preferred embodiment of the invention.

In a further variation, the embodiment of FIGS. 1-3 can be fabricated by welding together three plates, each plate being, for example, in the shape shown in FIG. 4. The plates can be configured so they are welded together end-to-end, thus creating a flat central disk portion 24, or they may be fabricated to overlap each other and thus be stacked on each other. In such a case, the central disk portion 24 would have a greater thickness equal to the number of stacked plates. Also, if the thickness of the plates is relatively thin overall, then it may be sufficient to have the thickness of the central disk portion 24 having steps formed where the plates overlap.

The central disk portion 24 has a number of leading edges 30, with the number of leading edges 30 corresponding to the number of extensions 26. Each leading edge 30 extends from the transition location of one of the extensions 26 outward to the beginning of the transition of the next adjacent extension 26.

As can be seen in FIG. 2, and as illustrated in more detail in FIG. 4, each leading edge 30 has an increasing radius from the center of the disk as it extends from the inside of one extension 26 to the outside of the other extension 26. That is, each leading edge 30 begins in the direction opposite to the direction of rotation with a smaller radius, and has its radius continually increase in the direction opposite to the direction of rotation until finally terminating at the next extension 26.

FIG. 4 illustrates a point A on the leading edge 30 of the central disk portion 24, located approximately 30 degrees from the beginning of the leading edge 30. At this point, there is an angle of attack (between the leading edge 30 and the material being mixed) included between the lines A1 (which illustrates a tangent line to the leading edge at that point), and a line A2 (which is a line perpendicular to the radius at that location). It will be appreciated that the next angle of attack between lines B1 and B2 at location B, which is approximately 60 degrees from the beginning of the leading edge 30, is higher than at A and increases further to a yet larger angle between lines C1 and C2 at location C.

Thus, the leading edge 30 forms a continuous outward spiraling shape. A benefit of this continued outward spiraling shape is that the leading edge 30 cuts its way through the material in such a fashion that "rags" tend to be minimized and not to adhere to the leading edge 30. The angle between the leading edge 30 and the material being mixed (the angle of attack) is kept to be a suitably small angle but is also continuously gradually changing to a larger angle, so that the leading edge 30 tends to be in shear with the material being mixed and tends not to collect "rags."

In the examples illustrated in FIGS. 1-4, the angle of attack is gradually increasing continuously along its length. However, in other embodiments, it may be only a portion of the leading edge 30 that has this gradual change in angle of attack. In such instances, some parts of the leading edge 30 may be simply arcuate (circular) around the center of rotation of the blade. Also, the circular or spiral arcs described herein can be composed of adjacent straight segments approximating a circular or spiral shape.

The extensions 26 illustrated in FIG. 3 are in the form of a flat planar paddle. However, the extensions 26 can have any shape, and, rather than being flat, may be curved or be formed of multiple flat pieces at angles to each other. Further, the trailing edge of the extensions 26 are illustrated as a flat linear trailing edge 29. However, if desired for the application or in some instances to further reduce rag collection on the trailing edge, the trailing edges 29 may be serrated, curved, castellated, or otherwise shaped.

The sides 34 and 36 of the extensions are illustrated as being generally straight or slightly arcuate. The outer side edge 34 is illustrated as being a shape resulting from initial formation of a flat plate 24, and thus the edge 34 is a geometric continuation of the leading edge 30. The inner edge of the extension 26 is illustrated as being that which results from providing a cut line into the plate 24 as essentially a continuation of the leading edge 30, at the illustrated location. However, the side edges 34 and 36 can also have other shapes, and for example, the extensions 26 rather than being a relatively rectangular flat extension, as illustrated, could be triangular, trapezoidal, or have any other shape. This may be particularly advantageous where the extensions 26 are a separately formed piece that is independently welded onto the central disk portion 24.

An advantage of the embodiment illustrated in FIGS. 1-3 is that it can be extremely simple to manufacture. A flat sheet material can be cut, and then have each extension bent downwardly. Of course, other manufacturing methods may be used, and as discussed above, the entire impeller 10 can be integral, or made of a plurality of individual components which are attached together.

An advantage of this manufacturing method is also that a single set of flat impeller blanks can be cut out, and then different ones can have each of their blades bent to different bend angles, permitting easy, test, adjustment, or adaptation of the impellers. Different power factors or performance are possible from the same blank simply by varying the angle at which the extensions are bent.

In this description of the preferred embodiment, the word "blade" and "impeller" are used to refer to the entire impeller structure, which includes a central disk portion that forms leading edges 30, as well as the extensions 26. Of course, the extensions 26 could each be considered as blades, and are also referred to as flow inducer portions. The selection of the term "blade" to describe the entire impeller and the use of "extensions" to describe those components is for convenience and not intended to limit the scope of the description in any way. Also, the "disk," "disk portion," "central disk portion" and "central disk region" and the like refer to the flat structure that comprises the leading edges, or to the structure other than the extensions.

Figure 5:
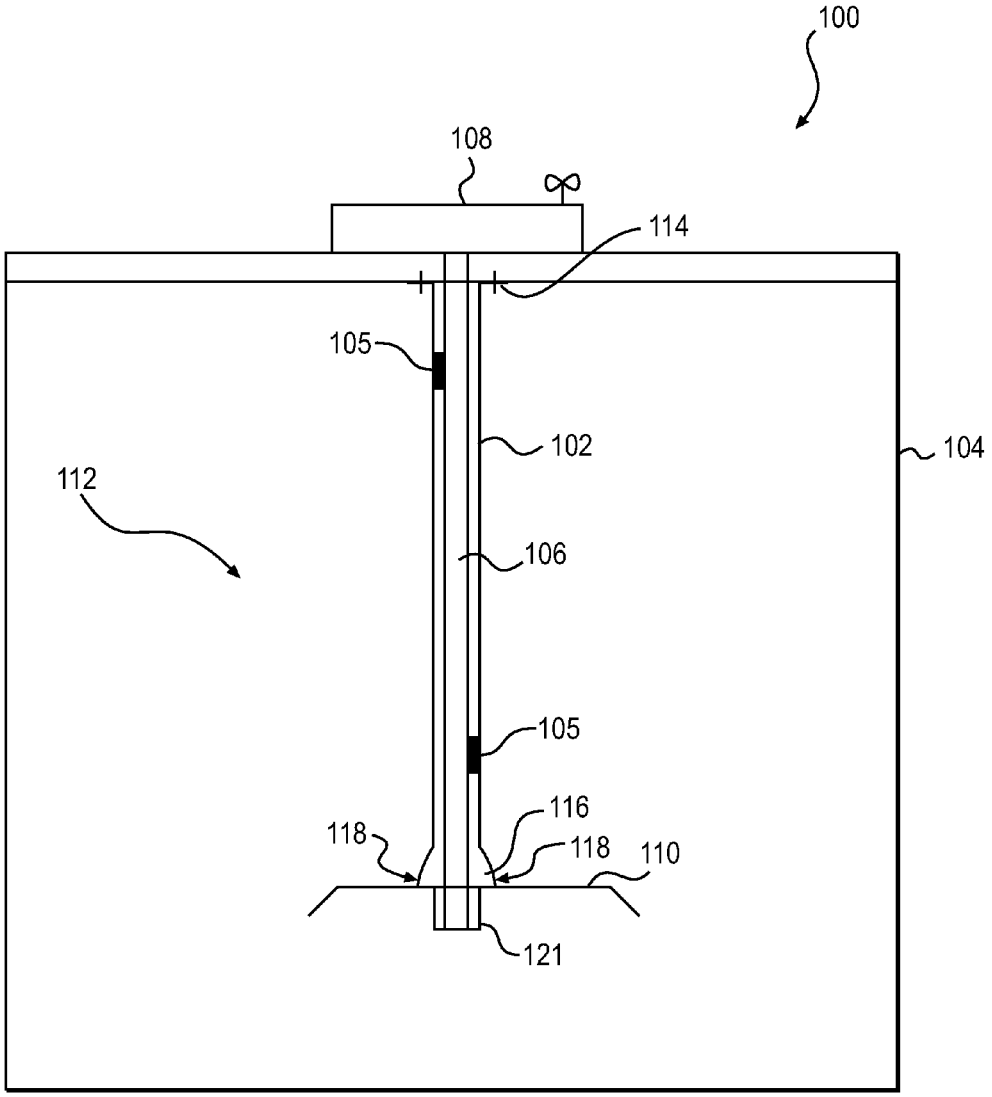
FIG. 5 is a schematic side view of a mixing system employing the impeller depicted in FIGS. 1-4 along with the shaft conduit in accordance with an embodiment of the present invention.

Turning now to FIG. 5, a schematic view of a mixing system, generally designated 100, having a stationary shaft or conduit 102 disposed within a mixing vessel 104. The mixing system 100 further includes a rotating shaft 106 disposed within said stationary shaft or conduit 102. The rotating shaft 106 extends through the base plate 108 and is attached to a mixer motor (not pictured) wherein said motor powers the rotating shaft. The rotating shaft 106 extends from the base plate 108 as illustrated, into the mixing vessel 104 interior 112 where the impeller 110 is attached thereto.

As illustrated in FIG. 5, the stationary shaft 102 may be mounted to the underside of the mounting plate 108 or the top of the vessel at an upper mounting position 114 via bracket or the like. The stationary shaft 102 is preferably a conduit or tube as previously discussed and constructed preferably from lightweight materials and can be any thin wall, light weight stationary conduit. Light weight materials such as aluminum, polyvinylchloride (PVC) or any other desired material may be used. The stationary shaft 102 extends from its upper mounting position 114 into the vessel 104 interior 114 where it terminates at the upper surface of the rotating impeller 110. The stationary shaft or conduit 102 may have slots or ports 105 in some embodiments that will allow for flow between the isolated rotating shaft 106 and the exterior fluid within the interior of the vessel 112. This described termination provides a gap 116 between the impeller 110 and the stationary shaft 102. In one preferred embodiment, the system 100 may use an elastomeric material 118 such as a bushing, washer or other desired seal design that mounts and fills the gap 116 of the intersection of the stationary shaft 102 and the rotating impeller 110. The elastomeric material assists to help isolate the material in the tank from the rotating shaft 106 and prevent the likelihood of material accumulation on said shaft 106.

An impeller hub 121 connects the rotating shaft 106 and the impeller 110 at a location below the impeller 110. Mounting the hub below the impeller is preferred as it provides a clean surface for the elastomeric seal 118 to seal the impeller. Moreover, mounting the hub 121 under the impeller 110 will also allow the flow generated by the impeller 110 to effectively shield the hub 118.

Alternatively, an attachment piece or component may be utilized instead of the above described elastomeric seal. In such embodiments, the attachment piece or component may have a sphere or cone geometry, for example, and be attached or mounted to the fixed conduit 102. In these embodiments, the sphere or cone extends downwardly and outwardly towards the impeller 110 where it functions to isolate the material in the tank from the rotating shaft 106, and prevents the likelihood of material accumulation on said shaft 106.

Figure 6:
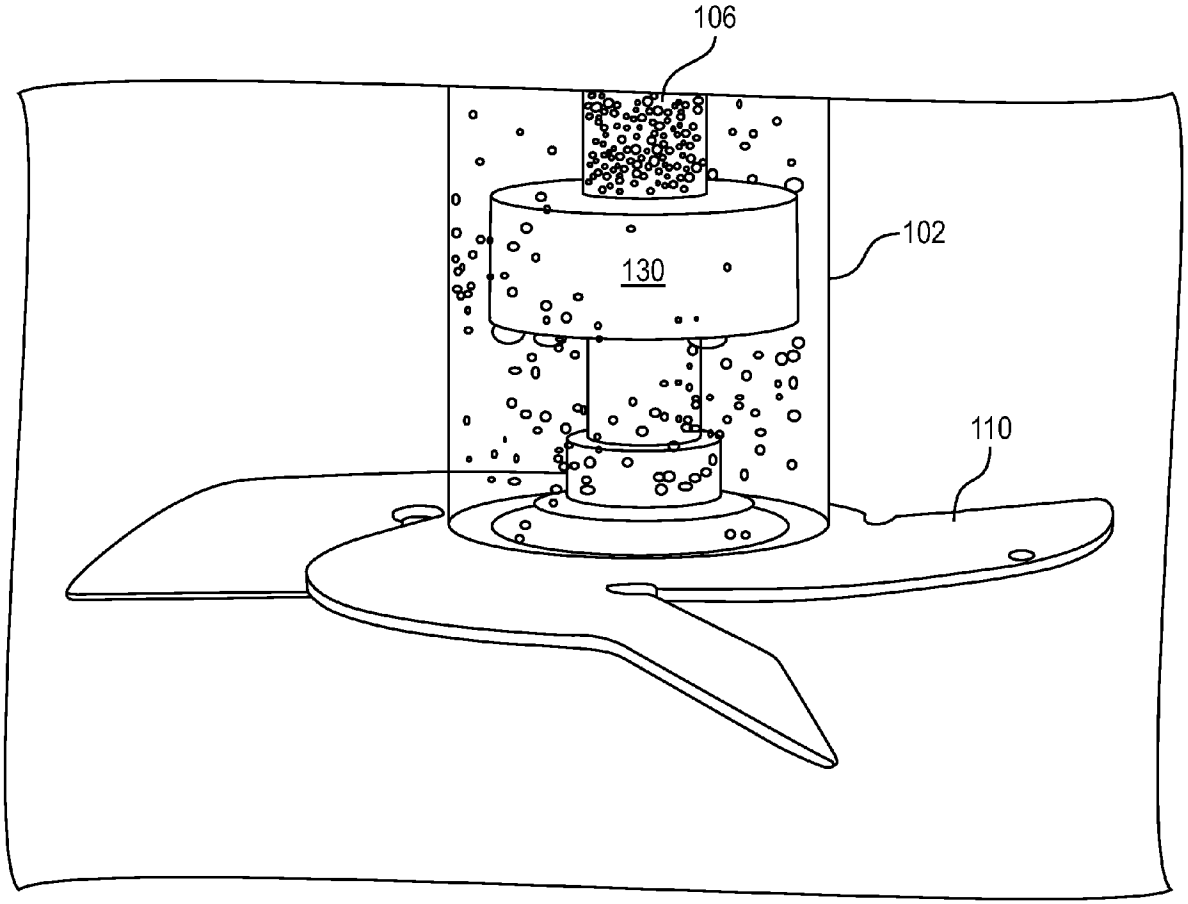
FIG. 6 is a schematic, perspective view of a mixer assembly in accordance with an alternative embodiment of the present invention.

Turning to FIG. 6, an alternative embodiment of the present invention is illustrated. While the embodiment is similar to that depicted in FIG. 5, the embodiment, generally designated 120, employs a centering device 130, for example, a bushing, at the lower end of the stationary conduit 102, near the impeller 110. The centering device 130 is preferably positioned such that it encircles the rotating shaft 106 and it functions to keep the rotating shaft 106 concentric with the stationary conduit 102. Moreover, the centering device 130 may be desired in some applications due to side loading resulting from fluid forces or alternatively as an alignment guide for the rotating shaft 106 during operation.

As previously discussed in connection with FIGS. 1-3, the illustrated impeller 10 includes a central disk region 24 which is substantially in the shape of a flat plate. One or more (in this case three) downwardly bent extensions 26 are provided and angle away from the disk region 24 as shown. In the illustrated example, the extensions 26 project away from the plane of the central disk portion 24 by a band angle X of approximately 30 degrees. It will be appreciated that this angle can be varied anywhere from practically zero up to 90 degrees, or anything up to 180 degrees. In the example shown, the 30 degree angle provides for generally axial flow pumping. If the blade is bent to 90 degrees, more radial flow pumping will occur.

In the example, three projecting extensions 26 are illustrated; however, any number of one or more, preferably two or more, extensions may be provided. In most preferred embodiments, the extensions will be two or more and will be symmetrically disposed around the circumference of the central disk region 24. Also, as discussed further below, the impeller blade 10 may optionally be a unitary design as shown in FIGS. 1-3. Such a design is convenient to form from a single flat plate which is cut to the desired outline shape, and then can have the extensions 26 bent downwardly by a suitable mechanical process.

However, in some cases, for example, in the case of large size impellers, it may be desirable to fabricate the impeller 10 from a plurality of parts that are welded together or otherwise attached to each other. For example, the individual extensions 26 can each be welded on at an angle to the central disk portion 24, and/or the central disk 24 itself and an associated extension can be made of individual components each with an associated extension.

During operation, the stationary shaft or conduit 102 is mounted to the underside of the mixing vessel 104 as previously discussed. The rotating shaft 106 is disposed therein and is connected to a motor which drives said shaft 106. The impeller 110 is connected to the rotating shaft 106. The rotating shaft 106 operates or rotates within the stationary shaft or conduit 102, allowing the rotating surface of the shaft to be sheltered from the mixing fluids and preventing contact between the fluids and the rotating shaft. Because the rotating shaft surface does not contact the fluid, the likelihood of solids or "rags" attaching to it during operation is significantly reduced.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A mixing system for mixing components in a vessel having a top portion and a bottom portion, comprising:

a fixed conduit connected to the top portion of the vessel that extends at least partially to the bottom portion;

a rotating shaft having a first end and a second end disposed within said fixed conduit that rotates within said fixed conduit while the mixing system is in operation;

an impeller connected to said rotating shaft at said second end wherein said impeller sealingly engages said fixed conduit such that said rotating shaft is sealed from the vessel within said fixed conduit, said impeller comprising:

a central disk portion having a center axis;

at least a pair of extensions extending at an angle from the central disk portion; and at least two leading edges defined by an outer periphery of the central disk portion, each leading edge spanning from one extension to an adjacent extension, and each leading edge having at least a portion at which the radius of the leading edge from the center axis increases to form a continuous increasing radius curve.

2. The mixing system according to claim 1, wherein said fixed conduit extends to cover said rotating shaft to create a space between said fixed conduit and said impeller.

3. The mixing system according to claim 2, further comprising a seal disposed within said space.

4. The mixing system according to claim 1, wherein said stationary conduit is a thin wall lightweight stationary conduit.

5. The mixing system according to claim 1 wherein the rotating shaft is connected to a mixer motor.

6. The mixing system according to claim 1, wherein said fixed conduit is mounted to a base plate.

7. The mixing system according to claim 1, wherein each leading edge has at least a portion having an outward increasing spiral profile.

8. The mixing system according to claim 1, wherein the central disk portion lies substantially in a plane, and each extension projects away from the disk at an angle relative to the plane.

9. The mixing system according to claim 1, wherein the number of extensions comprises two and the number of leading edges comprises two, and wherein the extensions and the leading edges are symmetrical with each other.

10. The mixing system according to claim 1, wherein the number of extensions comprises at least three and the number of leading edges comprises at least three, and wherein the extensions and the leading edges are symmetrical with each other.

11. The mixing system according to claim 1, further comprising a hub mounted to the central disk portion to facilitate mounting of the impeller onto the rotating shaft.

12. A mixing apparatus, comprising:

a motor;

a fixed conduit sealingly connected to a base;

a rotating shaft having a first end and a second end that is disposed within said fixed conduit that rotates within said fixed conduit wherein said first end is connected to said motor; and an impeller connected to said second end of said rotating shaft and wherein said impeller sealingly engages said fixed conduit such that said rotating shaft is sealed within said fixed conduit;

said impeller comprising a central disk portion having a center axis;

at least a pair of extensions extending at an angle from the central disk portion; and at least two leading edges defined by an outer periphery of the central disk portion, each leading edge spanning from one extension to an adjacent extension, and each leading edge having at least a portion at which the radius of the leading edge from the center axis increases to form a continuous increasing a radius curve.

13. The mixing system according to claim 12, wherein said fixed conduit extends to cover said rotating shaft to create a space between said fixed conduit and said impeller.

14. The mixing system according to claim 13, further comprising a seal disposed within said space.

15. The mixing system according to claim 12, wherein said stationary conduit is a thin wall lightweight stationary conduit.

16. The mixing system according to claim 12, wherein each leading edge has at least a portion having an outward increasing spiral profile.

17. The mixing system according to claim 12, wherein the central disk portion lies substantially in a plane, and each extension projects away from the disk at an angle relative to the plane.

18. A mixing system for mixing a fluid in a vessel, comprising:

means for placing the material to be treated in a vessel; and means for disposing a rotational shaft within a fixed conduit connected to the vessel;

means for rotationally driving the rotational shaft having an impeller blade attached thereto, wherein the impeller sealingly engages the fixed conduit such that the rotating shaft is sealed from the vessel, within the fixed conduit, the impeller blade comprising:

a central disk portion having a center axis;

at least a pair of extensions extending from the central disk portion; and at least two leading edges defined by the outer periphery of the central disk portion, each leading edge spanning from one extension to an adjacent extension, and each leading edge having at least a portion at which the radius of the leading edge from the center axis increases to form a continuous increasing radius curve.

* * * * *